United States Patent [19]

Amacker

[11] Patent Number: 4,796,364

[45] Date of Patent: Jan. 10, 1989

[54] PENDULUM BOW SIGHT

[76] Inventor: Joseph A. Amacker, Rte. 3, Box 41, Tallulah, La. 71282

[21] Appl. No.: 141,041

[22] Filed: Jan. 5, 1988

[51] Int. Cl.[4] ..... F41G 1/46

[52] U.S. Cl. ..... 33/265

[58] Field of Search ..... 33/265, 241; 124/87

[56] References Cited

U.S. PATENT DOCUMENTS

| | | | |
|---|---|---|---|
| 4,535,544 | 8/1985 | Jones | 33/265 |
| 4,580,349 | 4/1986 | Webb et al. | 33/265 |
| 4,616,422 | 10/1986 | Gaddy | 33/265 |

*Primary Examiner*—Harry N. Haroian

*Attorney, Agent, or Firm*—Wigman & Cohen

[57] ABSTRACT

A pendulum bow sight has a sight housing, a pendulum sight mounted within the sight housing, and a sight window disposed on the sight housing. A plurality of sighting pins are mounted on both vertical sides of the sight window. The sight window may be moved relative to the sight housing between a first position in which the sighting pins are located within the sight of the sight housing and a second position in which the sighting pins are located outside the line of sight of the sight housing. The pendulum sight is movable between a first position in which the pendulum sight is locked out of the line of sight of the sight housing and a second position in which the pendulum is allowed to pivot freely within the line of sight of the sight housing. The pendulum uses a light emitting diode as the sighting bead and means for conveniently turning the light emitting diode on and off are provided.

33 Claims, 3 Drawing Sheets

PENDULUM BOW SIGHT

BACKGROUND OF THE INVENTION

The present invention relates to archery bow sights and more particularly to pendulum bow sights.

A search of the prior art failed to uncover any prior art references which disclose the pendulum bow sight of the present invention. A number of patents were uncovered which disclose pendulum bow sights. The following is a listing of the patents uncovered during the aforementioned search:

| U.S. Pat. No. | Patentee | Issue Year |
|---|---|---|
| 4,535,544 | Jones et al | 1985 |
| 4,580,349 | Webb et al | 1985 |
| 4,616,422 | Gaddy | 1986 |

Jones et al is directed to a pendulum bow sight having a light emitting diode as the sighting element. Jones et al does not disclose a separate sight window mounted on the sight housing and having sighting pins for on-ground shooting, as well as for shooting from a height. Thus, the sight of Jones et al is not designed to be used to shoot both from an on-ground position as well as an elevated position.

Webb et al is directed to a pendulum bow sight having a plurality of sight pins secured to the forward position of the frame of the bow sight. The means for holding the sighting pins in position on the frame are fixed with respect to the portion of the frame holding the pendulum sight. Accordingly, the sighting pins cannot be moved as a unit out of the line of sight of the pendulum sight.

Gaddy discloses a similar pendulum sight having a plurality of sight pins in which the means for holding the sight pins on a frame are fixed with respect to the pendulum sight. There is no provision for moving the sighting pins out of the sighting range of the archer when using the pendulum sight.

Another disadvantage of the prior art devices lies in the fact that all sighting pins are located on the same side of the frame supporting the pendulum sight. Accordingly, convenience in using the pins is hampered by the proximity of the adjustment means of the pins relative to each other.

A further disadvantage of the prior art devices lies in the failure to provide a means for locking the pendulum sight out of the view of the archer when it is desired to use the sight for on-ground shooting.

SUMMARY AND OBJECTS OF THE INVENTION

In view of the foregoing limitations and shortcomings of the prior art devices as well as other disadvantages not specifically mentioned above, it is a primary objective of this invention to provide a versatile pendulum bow sight which can be used either for on-ground shooting or for elevated shooting.

More particularly it is an object of this invention to provide a sight window which moves up and locks out of the way of the sight housing when it is desired to use the pendulum sight for elevated shooting.

It is another object of this invention to provide a sight window which has pins on both sides of a sight window and to provide the sight window with ridges for more accurately controlling the position of the sighting pins within the sight window.

Yet another object of this invention is to provide a fine windage adjustment on the sighting window for fine tuning of the sighting pins to compensate for windage effects.

Still another object of this invention is to provide a pendulum bow sight in which the pendulum sight may be locked up and out of the way of the sight window when it is desired to use the bow sight for on-ground shooting.

Still another object of this invention is to provide a means for turning on and off the light emitting diode of a pendulum bow sight in a convenient and effective manner.

Briefly described, the aforementioned objects are accomplished according to the invention by providing a pendulum bow sight having a sight housing, a pendulum sight mounted within the sight housing and a sight window having a plurality of sight pins adjustably arranged thereon, mounted on the sight housing so as to be movable on the sight housing between a first position in which the sight pins are disposed within the line of sight of the sight housing and a second position in which the sight pins are disposed outside the light of sight of the sight housing.

Means connected to the sight housing are provided for selectively locking the pendulum sight out of the line of sight of the plurality of sight pins. A light emitting diode is suspended from the pendulum sight as the sighting element for elevated shooting and means for selectively turning on and off the light emitting diode are located in the pendulum sight. The sight window is in the shape of a rectangular frame having a pair of vertical sides, and the sight pins are mounted on both vertical sides of the sight window. The sight window is formed of front and rear frames and a fine tuning windage adjustment in the form of a dovetail connection is provided between the frames. A plurality of closely spaced ridges is formed on the sight window for fine adjustment of the sighting pins.

With the foregoing and other objects, advantages and features of the invention that will become hereinafter apparent, the nature of the invention may be more clearly understood by reference to the following detailed description of the invention, the appended claims and to the several views illustrated in the attached drawings.

DESCRIPTION OF A PREFERRED EMBODIMENT

Figure 1:
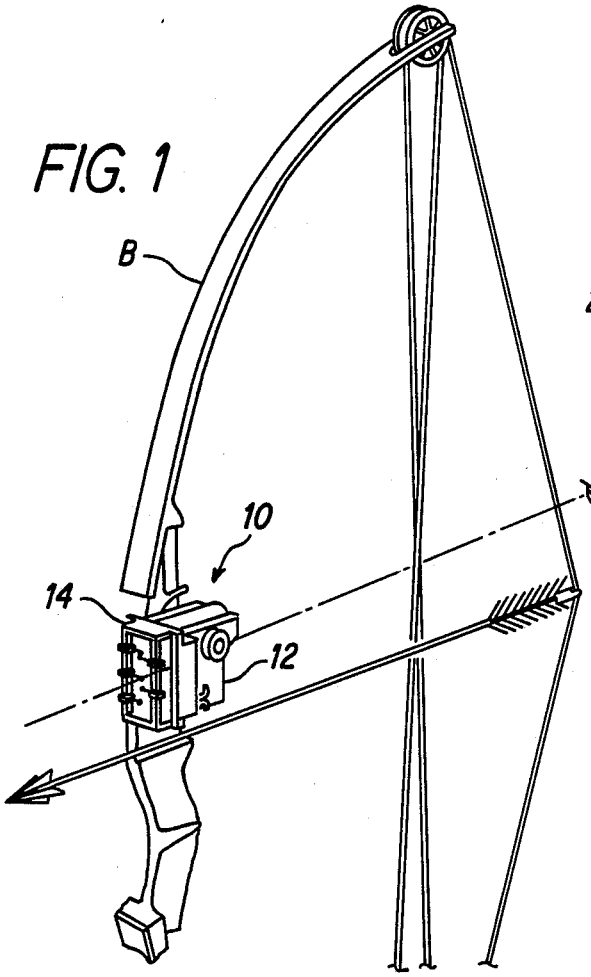
FIG. 1 is a perspective view illustrating the pendulum bow sight of the invention in position on a bow.
Figure 2:
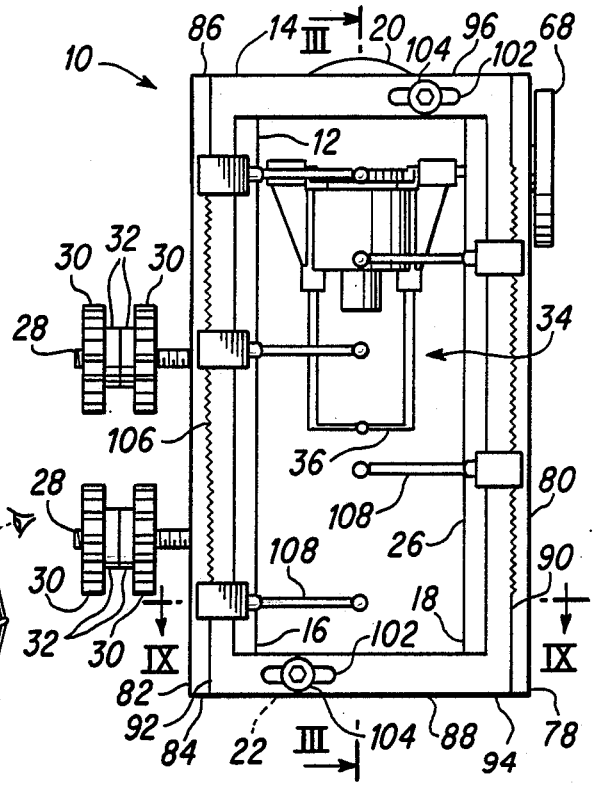
FIG. 2 is a front view of the pendulum bow sight in accordance with the invention.
Figure 3:
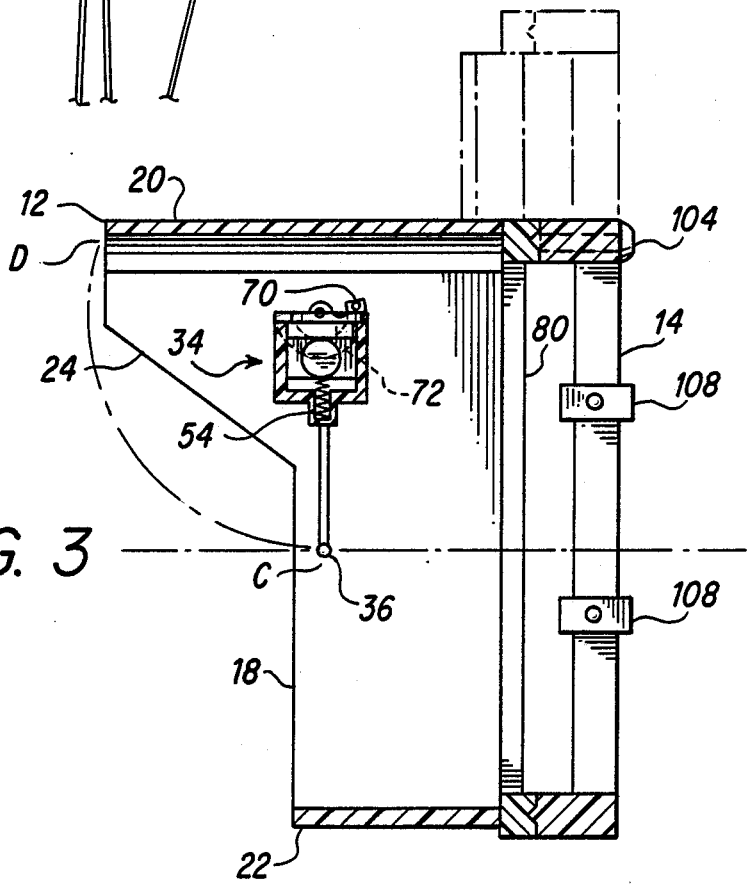
FIG. 3 is a sectional view taken along line III—III of FIG. 2.
Figure 4:
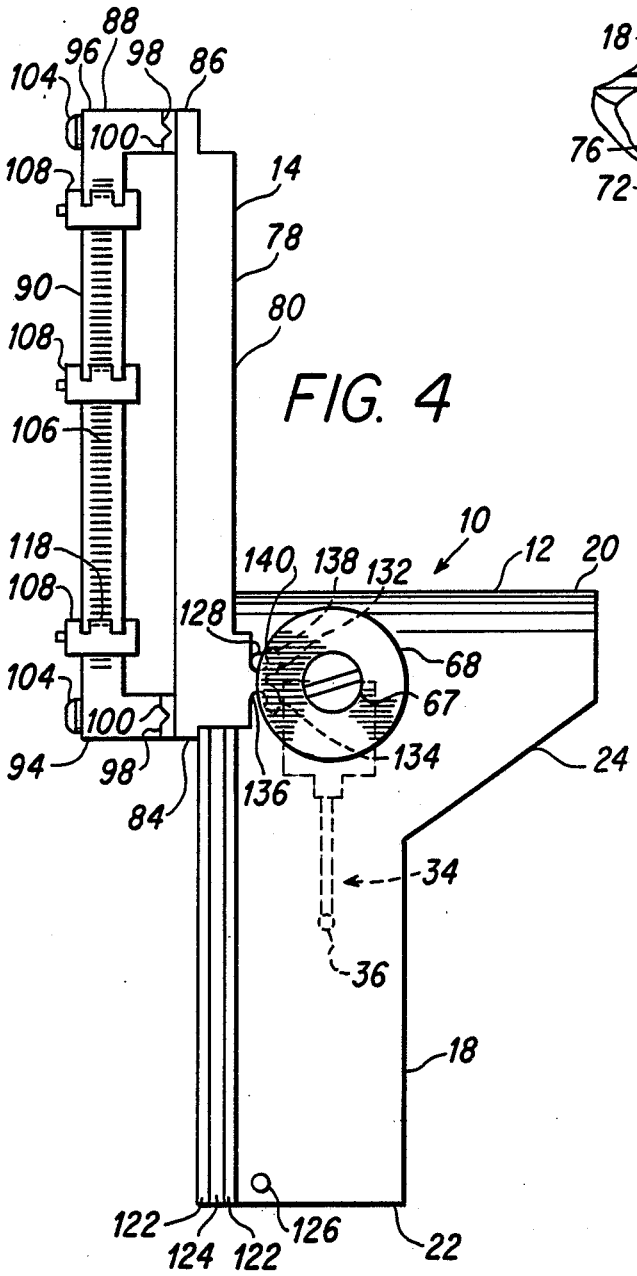
FIG. 4 is a side view of the pendulum sight of the invention, showing the sight window in its raised position.

Referring now in detail to the drawings where like parts are designated by like reference numerals throughout, there is illustrated in FIG. 1 a pendulum bow sight in accordance with the invention which is designated generally by reference numeral 10. Referring now to FIGS. 2 through 4 in conjunction with FIG. 1, the details of the pendulum bow sight 10 of the invention are illustrated.

Pendulum bow sight 10 comprises three main parts, a pendulum sight housing 12, a sight window 14 and a pendulum sight 34. Sight housing 12 and sight window 14 are made of molded plastic in the preferred embodiment and, together with pendulum sight 34, are adapted to cooperate to form the pendulum bow sight 10 of the present invention.

Sight housing 12 has vertically extending side walls 16, 18, a horizontally extending domed upper wall 20, and a horizontally extending lower wall 22. Side walls 16 and 18 are each provided with a rearwardly extending portion 24, for a purpose which will be described hereinafter. Side walls 16 and 18, upper wall 20, and lower wall 22 frame a rectangular opening 26, which, as illustrated in FIG. 2, provides a line of sight for the pendulum bow sight 10 when the bow sight is used for aiming at a target.

A pair of mounting bolts 28 are rigidly secured in the outer surface of side wall 16 for mounting pendulum bow sight 10 on the bow B, in a manner which is conventional in the art. To further assist in mounting pendulum bow sight 10 on bow B each bolt 28 is provided with a pair of knurled nuts 30 and washers 32. Pivotally suspended from side walls 16, 18, and beneath domed upper wall 20 of sight housing 12, is the pendulum sight 34. Details illustrating the construction and operation of pendulum sight 34 are further illustrated in FIGS. 5 through 8 of the drawings.

Pendulum sight 34 includes a light emitting diode 36 which is used as the sighting element or bead, a suspension element 38, a cap 40, and a pair of leads 42 each having a bent portion 43 for positioning light emitting diode 36 and connecting the light emitting diode to a battery 44. Suspension element 38 takes the form of a generally cylindrically shaped housing having a central bore 46 and a pair of diametrically opposed radially extending flanges 48. Supported on the upper surface of each of the flanges 48 is a bushing 50, and a pivot pin 52 is pressed into the interior of each of the bushings 50. A compression spring 54 is vertically disposed within a recess 56 formed in the lower portion of suspension element 38.

Cap 40 is provided at its underside with a pair of downwardly extending holder arms 58 which form a cylindrical recess 60 to slidingly hold disk-shaped battery 44 in arms 58. The lid of cap 40 is provided with a pair of diametrically opposed slots 62 for the passage therethrough of the inwardly extending ends of pins 52. A first pair of diametrically opposed depressions 64 are provided on the periphery of the top surface of the lid of cap 40, and a second pair of diametrically opposed depressions 66 are additionally provided on the periphery of the top surface of the lid of cap 40, angularly spaced a predetermined distance from the first pair of depressions 64.

To assemble the pendulum sight 34, a battery 44 is first placed within cylindrical recess 60 formed in extending holder arms 58 of cap 40. Cap 40 is then inserted in suspension element 38 with recesses 60 sliding past the inwardly extending ends of pins 52, against the force of spring 54. Cap 40 is then rotated so that depressions 62 are engaged by the inwardly extending ends of pins 52.

Pendulum sight 34 is pendulously mounted within sight housing 12 by means of a pair of screws 67 which are inserted through appropriate threaded holes formed in each of side walls 16, 18 of sight housing 12. Each of screws 67 is provided with a central bore longitudinally extending along the longitudinal axis of the screw at the end opposite the head of the screw to engage one of the outwardly extending ends of pins 52 pressed into bushings 50 of suspension element 38 to pendulously mount pendulum sight 34 within sight housing 12.

Means for locking pendulum sight 34 out of the line of sight of pendulum bow sight 10 are provided. The locking means include a knob 68 which is rotatably mounted on side wall 18 of pendulum sight housing 12 by means of one of the screws 67. A locking arm 70 is pressed into an inner surface of knob 68 and extends through a generally cylindrically shaped slot 72 formed in side wall 18, extending into the interior of pendulum sight housing 12 in overlapping relationship with one of the flanges 48 of suspension element 38 of pendulum sight 34. Cammed surfaces 74 and 76 are provided near the extremities of slot 72. When knob 68 is rotated so that locking arm 70 is in the position shown in FIG. 5, camming surface 74 acts as a lock to prevent rotation of knob 68 about screw 67 and to prevent the movement of locking arm 70 in slot 72. Locking arm 70 is thus prevented from contact with flange 48, further preventing interference of locking arm 70 with the pendulous movement of pendulum sight 34 within pendulum sight housing 12. In this condition, when sight housing 12 is held horizontally with respect to the ground, light emitting diode 36 will assume its lowest position within sight housing 12, or that of position C as illustrated in FIG. 3. Also in this condition, pendulum sight 34 is free to move pendulously within housing 12 so as to provide a pendulum bow sight, as is well known in the art.

Figure 5:
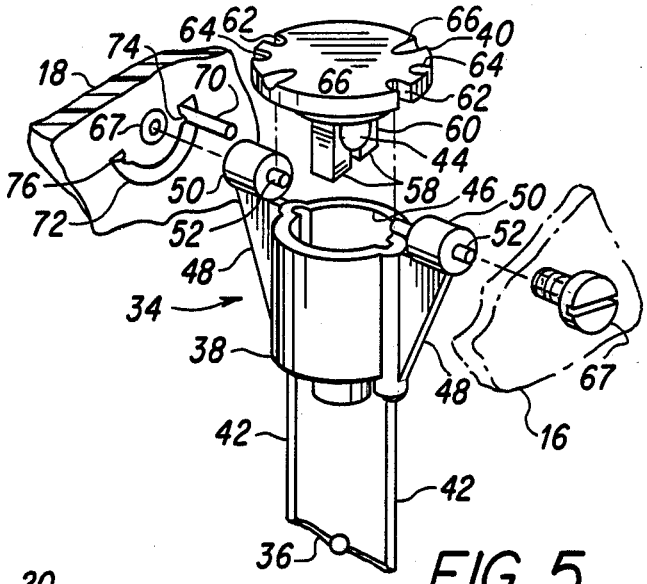
FIG. 5 is a detailed exploded view, in perspective, of the pendulum sight of the pendulum bow sight in accordance with the invention.
Figure 6:
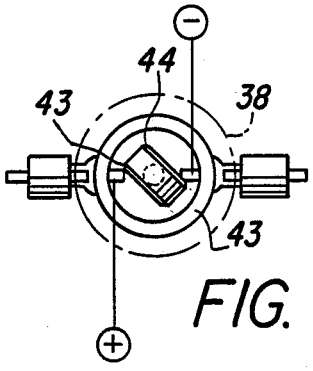
FIG. 6 is a top view of the pendulum sight in accordance with the invention, with the cap removed, showing the pendulum sight in its on condition.
Figure 7:
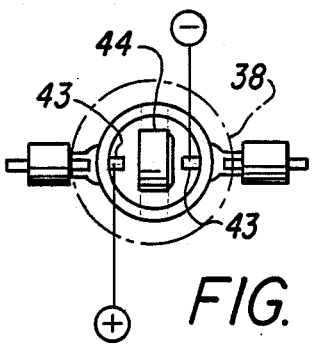
FIG. 7 is a view similar to FIG. 6 showing the pendulum sight in its off condition.
Figure 8:
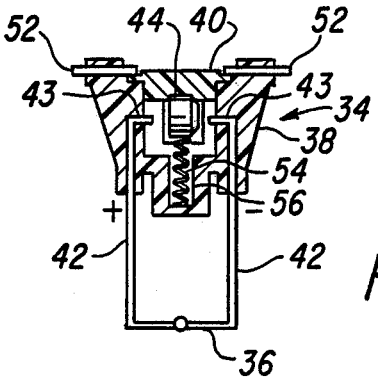
FIG. 8 is a sectional view of the pendulum sight in accordance with the invention.

Upon rotation of knob 68 in the counterclockwise direction as viewed in FIG. 4, or in the clockwise direction as viewed in FIGS. 3 and 5, locking arm 70 slides in slot 72 and engages a flange 48 of suspension element 38 to pivot pendulum sight 34. When knob 68 is rotated approximately 180°, locking arm 70 engages camming surface 76 of slot 72, thereby locking pendulum sight 34 in a position such that light emitting diode 36 is maintained at position D illustrated in FIG. 3. In this condition, pendulum sight 34 is contained primarily within the dome of domed upper wall 20 and is locked up and out of the way of the line of sight of sight housing 12. Further, leads 42 and light emitting diode 36 are protected by rearwardly extending portion 24 of side walls 16 and 18 of housing 12. Leads 42 and light emitting diode 36 are thus prevented from inadvertent damage by rearwardly extending portion 24.

Referring now once again to FIGS. 2, 3, and 4, details of the construction of sight window 14 and the means by which sight window 14 is vertically movable with respect to sight housing 12 will be described in detail. Sight window 14 comprises a rear frame 78 having opposed vertical side supports 80, 82, horizontal bottom support 84, and horizontal top support 86. In the preferred embodiment, rear frame 78 is molded together from plastic material as a single unit, with side supports 80, 82, bottom support 84 and top support 86 forming a continuous solid piece of molded plastic. Sight window 14 also includes a front frame 88 having vertical side supports 90, 92, horizontal bottom support 94, and horizontal top support 96. Similarly to rear frame 78, front frame 88 is made in the preferred embodiment from a single molded piece of plastic, with side supports 90, 92, bottom support 94, and top support 96 forming a continuous piece of molded plastic. Rear frame 78 and front frame 88 are connected together by a horizontally disposed dovetail connection, with a pair of horizontally disposed grooves 98, one of each of which is formed on each of lower support 84 and upper support 86 of rear frame 78, mating with a pair of horizontally disposed tongues 100, one of each of which is formed on each of lower support 94 and upper support 96 of front frame 88. One of a pair of horizontally elongated slots 102 are formed in each of lower support 94 and upper support 96 of front frame 88, and a suitable fastener 104, such as an allen head screw is passed through slots 102. The shank of fastener 104 is of sufficient length to abut grooves 98, thereby permitting a firm connection between front frame 88 and rear frame 78. Front frame 88 is thereby selectively horizontally slidable on rear frame 78, for a purpose which will be described hereinafter.

Figure 9:
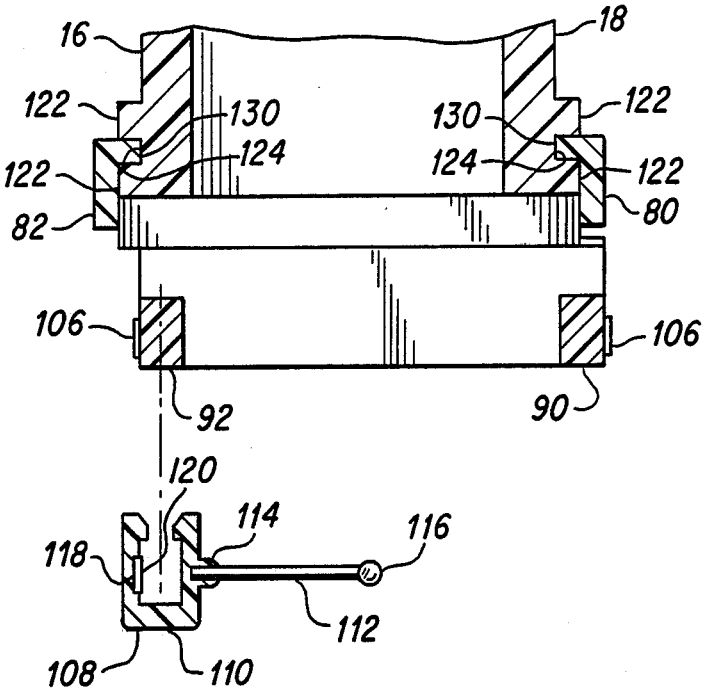
FIG. 9 is a partial sectional view taken along line IX—IX of FIG. 2.

Side supports 90, 92 of front frame 88 are provided on their outer sides with a plurality of fine ridges 106. A plurality of sighting pins 108 are adjustably mounted on each of side supports 90, 92. As is most clearly seen in FIGS. 4 and 9, sighting pins 108 include a U-shaped body 110, a shaft 112 which is pressed into a flange 114 projecting from body 110, and a bead 116 which is pressed into the opposite end of shaft 112. A tab 118 is formed in a reduced, cut-out section of body 110 and an overhanging lip 120 on the inside of tab 118 projects towards the inner side of U-shaped body 110, for cooperation with ridges 106. Sighting pins 108 may thereby be readily adjusted and retained in position on side supports 90, 92, by the cooperation of tabs 118 with ridges 106.

A pair of vertically disposed rails 122 are formed at the forward edge on the outside surface of each of side walls 16, 18 of sight housing 12, forming a recessed track 124 therebetween. A lower latch pin 126 is pressed into each of side walls 16, 18 in close proximity to rails 122 and lower wall 22. A pair of upper latch pins 128 are pressed into each of side walls 16, 18, in close proximity to rails 122 and upper wall 20.

A vertically extending rail 130 is formed on each of side supports 80, 82 of rear frame 78 of sight window 14. Rails 130 extend inwardly and are so dimensioned and configured as to mate with track 124 and rails 122 so as to freely slide therein. A double-sided latch 132 is formed on each of side supports 80, 82, at the bottom of the side supports and projecting rearwardly from rear frame 78. A lower hook 134 having a downwardly directed opening 136 and an upper hook 138 having an upwardly directed opening 140 are formed in latch 132. Openings 136, 140 are so dimensioned and configured as to frictionally engage and be retained on outwardly projecting latch pins 126, 128, respectively. Through the cooperation of rails 130 with rails 122 and track 124, and the cooperation of latches 132 with latch pins 126, 128 sight window 14 is adapted to be slidable on sight housing 12, between a first position, as illustrated in FIG. 1, in which sighting pins 108 are located within the line of sight of sight housing 12 and a second position, as illustrated in FIG. 4, in which sighting pins 108 are located outside the line of sight of sight housing 12. Further, when the sight window assumes the first position in which the sighting pins are located within the line of sight of the sight housing, the sight window 14 is firmly fixed or latched with respect to sight housing 12 by the cooperation of openings 136 of lower hook 134 with lower latch pins 126. When the sight window assumes the second position in which the sighting pins are located outside the line of sight of the sight housing, the sight window is firmly fixed or latched with respect to the sight housing by means of openings 140 of upper hooks 138 cooperating with upper latch pins 128.

In operation, the pendulum bow sight 10 is mounted on the bow B by means of mounting bolts 28, nuts 30 and washers 32. In order to sight in the pendulum sight, the archer climbs twelve (12) feet or above, locks the sight window 14 in the position illustrated in FIG. 4, and locks the locking arm 70 out of interfering position with pendulum 34, allowing the pendulum sight 34 to move pendulously within sight housing 12, as illustrated in FIGS. 3 and 4. The archer then sights a target at twenty (20) yards and zeroes in. If the arrow hits low, the archer then loosens nuts 30 and lowers pendulum bow sight 10 on bow B. If the arrow hits high, the archer raises pendulum bow sight 10 on bow B. This adjustment is repeated until a correct elevation is set.

The archer next corrects the position of the bow sight for windage. To correct for windage, the archer shoots an arrow and if it hits to the left, the archer uses nuts 30 to move the bow sight to the left. If the arrow hits right, the archer moves the sight to the right. This is repeated until the sight is zeroed in, and then the nuts 30 are locked down tight. The archer then climbs down, locks up pendulum sight 34 in position D illustrated in FIG. 3 using knob 68, and lowers sight window 14 on sight housing 12 to the position shown in FIG. 1, with openings 136 of lower hooks 134 latched on lower latch pins 126. The windage has already been set for the sight pins 108 by setting the windage for pendulum sight 34. The archer then sets each of sight pins 108 one pin at a time for a desired shooting distance by zeroing in each sight pin 108 individually. If the archer finds it necessary to make a fine windage adjustment to the beads, the archer may do so by loosening the two allen head screws 104 on front frame 88 of sight window 14 and horizontally adjusting front frame 88 to the right or left with respect to rear frame 86. After the archer completes sighting in the bow sight he is ready to hunt or shoot.

When the archer is shooting from the ground he locks up the pendulum sight 34 in the position D illustrated in FIG. 3 and positions sight window 14 in front of sight housing 12 so that a clear line of sight is presented for sight pins 108. When the archer is shooting from an elevated height the archer raises the sight window 14 and latches it in its upper position, as illustrated in FIG. 4. The archer then releases pendulum sight 34 using knob 68 and uses the pendulum sight to compensate when shooting. With the pendulum sight set at twenty (20) yards according to how strong the bow is, the archer can accurately estimate the shooting position to reach targets out to forty (40) yards and may shoot back accurately to zero yardage.

Also when shooting from an elevated position, the archer can light up light emitting diode 36 by manipulation of cap 40. When cap 40 is in the position in which depressions 64 are positioned beneath the inwardly extending ends of pins 52, battery 44 assumes the position illustrated in FIG. 7 in which the battery does not contact bent portions 43 of leads 42, so that no current flows through the light emitting diode 36. When cap 40 is depressed against the force of spring 56 and rotated so that depressions 66 are lined with the inwardly extending ends of pins 52, battery 44 is rotated so as to contact both bent ends 43 of leads 42, allowing current to flow through light emitting diode 36, and lighting the light emitting diode. When the cap is released depressions 66 are retained against the inwardly extending ends of pins 52 by spring 56, maintaining the battery in the position illustrated in FIG. 6, and keeping the light emitting diode lit. In order to turn off the light emitting diode, cap 40 is simply depressed and rotated to the position in which depressions 64 are aligned with the inwardly extending ends of pins 52.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A pendulum bow sight comprising:

a sight housing;

a pendulum sight mounted within said sight housing;

a sight window disposed on said sight housing, said sight window adapted to have a plurality of sighting pins mounted thereon; and means for moving said sight window relative to said sight housing between a first position in which said sighting pins are located within the line of sight of said sight housing and a second position in which said sighting pins are located outside the line of sight of said sight housing.

2. The pendulum bow sight of claim 1 further comprising means for moving said pendulum sight between a first position in which said pendulum sight is allowed to pivot freely within the line of sight of said sight housing and a second position in which said pendulum sight is positioned out of the line of sight of said sight housing.

3. The pendulum bow sight of claim 1 further comprising means for latching said sight window in said first position in which said sighting pins are located within the line of sight of said sight housing.

4. The pendulum bow sight of claim 1 further comprising means for latching said sight window in said second position in which said sighting pins are located outside the line of sight of said sight housing.

5. The pendulum bow sight of claim 1 wherein said means for moving said sight window relative to said sight housing comprises a pair of rails vertically disposed on said sight housing and a rail vertically disposed on said sight window and slidable on the pair of rails on said sight housing.

6. The pendulum bow sight of claim 5 wherein said sight housing comprises a generally rectangular-shaped frame having a top wall, a bottom wall, and two side walls, each having an outside surface, wherein said means for moving said sight window relative to said sight housing comprises two pairs of rails, one of each of said pairs of rails being vertically disposed on one of each of said outside surfaces of said side walls of said sight housing.

7. The pendulum bow sight of claim 6 wherein said sight window comprises a generally rectangularly-shaped frame having a top support, a bottom support, and two side supports, wherein said means for moving said sight window relative to said housing comprises two rails, one of each of said rails being vertically disposed on one of each of said side supports of said sight window and slidable on one of each of said pairs of rails on said sight housing.

8. The pendulum bow sight of claim 7 further comprising means for latching said sight window in said second position in which said sighting pins are located outside the line of sight of said sight housing.

9. The pendulum bow sight of claim 8 wherein said means for latching said sight window in said second position in which said sighting pins are located outside the line of sight of said sight housing comprises an upper latch pin fixed in a side wall of said sight housing extending outwardly from the outside surface of said side wall, and an upper hook formed on a side support of said sight window, said upper hook forming an opening so dimensioned and configured as to frictionally engage said upper latch pin.

10. The pendulum bow sight of claim 9 wherein two upper latch pins and two upper hooks are provided, one of each of said upper latch pins being fixed in one of each of said side walls of said sighting housing extending outwardly from the respective outside surfaces of said respective side walls, one of each of said upper hooks being formed on one of each of said side supports of said sight window, each of said upper hooks forming an opening so dimensioned and configured as to frictionally engage the respective upper latch pin.

11. The pendulum bow sight of claim 8 further comprising means for latching said sight window in said first position in which said sighting pins are located within the line of sight of said sight housing.

12. The pendulum bow sight of claim 11 wherein said means for latching said sight window in said first position in which said sighting pins are located within the line of sight of said sight housing comprises a lower latch pin fixed in a side wall of said sight housing extending outwardly from the outside surface of said side wall, and a lower hook formed on a side support of said sight window, said lower hook forming an opening so dimensioned and configured as to frictionally engage said lower latch pin.

13. The pendulum bow sight of claim 12 wherein two lower latch pins and two lower hooks are provided, one of each of said lower latch pins being fixed in one of each of said side walls of said sight housing extending outwardly from the respective outside surfaces of said respective side walls, one of each of said lower hooks being formed on one of each of said side supports of said sight window, each of said lower hooks forming an opening so dimensioned and configured as to frictionally engage the respective lower latch pin.

14. The pendulum bow sight of claim 2 wherein said sight housing further comprises a domed upper wall for receipt of said pendulum sight when said pendulum sight is in said second position in which said pendulum sight is positioned out of the line of sight of said sight housing.

15. The pendulum bow sight of claim 2 wherein said sight housing further comprises a rearwardly extending portion covering said pendulum sight when said pendulum sight is in said second position in which said pendulum sight is positioned out of the line of sight of said sight housing.

16. The pendulum bow sight of claim 2, in which said pendulum sight includes a body pendulously mounted in said sight housing wherein said means for moving said pendulum sight comprises;

a flange projecting from the body of said pendulum sight;

a semi-cylindrical slot formed in said sight housing;

a knob rotatably mounted on an outer surface of said sight housing, said knob having a locking arm fixed therein, said locking arm disposed so as to project through said slot into the interior of said sight housing in overlapping relationship with the flange of the body of said pendulum sight;

whereby when said knob is rotated, said locking arm engages said flange to move said pendulum sight from said first position in which said pendulum sight is allowed to pivot freely to said second position in which said pendulum sight is positioned out of the line of sight of said sight housing.

17. The pendulum bow sight of claim 16 in which a first camming surface is provided at a first end of said slot formed in said sight housing for engagement with said locking arm whereby said pendulum sight is locked in said second position of said pendulum sight when said knob is rotated so that said locking arm engages said first camming surface.

18. The pendulum bow sight of claim 17 in which a second camming is provided in a second end of said slot formed in said sight housing for engagement with said locking arm whereby said locking arm is locked at said second end of said slot to prevent interference with the pendulous movement of said pendulum sight in said first position of said pendulum sight.

19. A pendulum bow sight comprising:

a sight housing;

a sight window mounted on said sight housing, said sight housing having a plurality of sight pins adjustably arranged thereon;

a pendulum sight mounted within said sight housing; and means connected to said sight housing for selectively locking said pendulum sight out of the line of sight of said plurality of sight pins.

20. The pendulum bow sight of claim 19 in which said pendulum sight includes a body pendulously mounted in said sight housing, wherein said means for selectively locking said pendulum sight out of the line of sight of said plurality of sight pins comprises:

a flange projecting from the body of said pendulum sight;

a semi-cylindrical slot formed in said sight housing, said slot having a camming surface formed at one end thereof;

a knob rotatably mounted on an outer surface of said sight housing, said knob having a locking arm fixed thereon, said locking arm disposed so as to project through said slot into the interior of said sight housing in overlapping relationship with the flange of the body of said pendulum sight;

whereby when said knob is rotated, said locking arm engages said flange to move said pendulum sight from a first position in which said pendulum sight is allowed free pendulous movement in said sight housing to a second position in which said pendulum sight is locked out of the line of sight of said plurality of sight pins.

21. The pendulum bow sight of claim 20, wherein said pendulum sight includes a sighting bead, and said sighting bead comprises a light emitting diode.

22. The pendulum bow sight of claim 21 wherein;

said pendulum sight body comprises a pair of diametrically opposed flanges extending outwardly from said body, a pair of bushings, one of each of said bushings supported on one of each of said flanges, and a pair of pins, one of each of said pins horizontally supported on one of each of said bushings, each of said pins having an inner end and an outer end projecting from the bushing on which the pin is supported;

said sight housing comprises a pair of opposed, vertical side walls, each of said side walls having a threaded opening formed therein, a pair of threaded fasteners, one of each of said fasteners extending through one of each of said openings in said side walls; and one of each of said fasteners engages one of each of the outer ends of said pins for free pendulous movement of said pendulum sight in said sight housing.

23. The pendulum bow sight of claim 22 wherein one of said fasteners, in addition to engaging the outer end of one of said pins, also supports said knob for rotation on the outer surface of the side wall through which said one of the fasteners extends.

24. The pendulum bow sight of claim 23 wherein;

said pendulum sight body has a generally cylindrical shape and a central bore, a lower portion of said pendulum sight body having a vertically disposed recess, a spring member received in said recess of the lower portion of said pendulum sight body, a pair of vertically disposed leads diametrically fixed at the periphery of said cylindrically shaped body and projecting downwardly from said cylindrically shaped body, each of the bottom ends of said leads electrically connected to one of the ends of said light emitting diode, each of the top ends of the leads bent inwardly so as to project into the central bore of the cylindrically shaped body; and said pendulum sight includes a cap having a lid and a pair of downwardly extending holder arms forming a recess therein adapted to slidingly receive a battery, said lid having a pair of diametrically opposed slots formed at the periphery of the lid;

whereby said cap is mounted on said pendulum sight body to position the battery within the central bore of the pendulum sight body by sliding the slots on the lid past the inner ends of the pins supported on the bushings of the pendulum sight body, rotating the cap so as to clear the pins, and releasing the cap so that the cap is retained on the body by the pins, against the force of the spring member.

25. The pendulum bow sight of claim 24 wherein a first and second pair of diametrically opposed depressions are provided on the upper surface of the lid, said first and second pair of depressions being angularly spaced a predetermined distance apart from each other and positioned with respect to said holder arms such that when the cap is rotated so that said first pair of depressions are aligned with the inner ends of the pins supported on the bushings said leads do not contact said battery and said light emitting diode is turned off, and when the cap is rotated so that said second pair of depressions are aligned with the inner ends of the pins supported on the bushings said leads contact said battery and said light emitting diode is turned on.

26. A pendulum bow sight comprising:

a sight housing;

a pendulum sight mounted within said sight housing;

a sight window disposed on said sight housing;

said sight window being in the shape of a rectangular frame having a pair of vertical sides; and sight pins adjustably mounted on both vertical sides of said sight window.

27. The pendulum bow sight of claim 26 further comprising means for moving said sight window horizontally with respect to said sight housing.

28. The pendulum bow sight of claim 27 wherein said means for horizontally moving said sight window comprises a rear frame mounted for vertical movement on said sight housing and a front frame mounted for horizontal movement on said rear frame.

29. The pendulum bow sight of claim 28 wherein said front frame is mounted on said rear frame by means of a dovetail connection.

30. The pendulum bow sight of claim 29 wherein said dovetail connection comprises a pair of horizontally extending tongues disposed on said front frame and a pair of horizontally extending grooves mating with said tongues disposed on said rear frame.

31. The pendulum bow sight of claim 30 wherein;

said rear frame includes vertical sides, a top support and a bottom support, one of said grooves is formed on each of said top and bottom supports of said rear frame;

said front frame includes a top support and a bottom support, one of said tongues is formed on each of said top and bottom supports of said front frame, a slot is formed on each of said top and bottom supports of said front frame extending from the front surface of the front frame to the rear surface of the front frame; and a fastener is passed through each of the slots on the top and bottom supports of said front frame, the head of each fastener in engagement with the front side of said front frame and the end of each fastener opposite the head in engagement with the rear frame.

32. The pendulum bow sight of claim 31 wherein a plurality of fine ridges are provided on the outer surfaces of each of the vertical sides of said sight window for adjustment of said sight pins on said sight windows.

33. The pendulum bow sight of claim 32 wherein said sight pins comprise a U-shaped body having two legs, a shaft projecting from the outside surface of one of said legs, a bead supported on the end of said shaft opposite the end of the shaft projecting from the outside surface of said leg, said opposite leg having a reduced, cut-out section forming a tab, said tab forming an overhanging lip on the inside surface of said opposite leg, said lip projecting toward the inner side of said U-shaped body into engagement with said ridges for adjustment of said sight pins on said sight window.

* * * * *